United States Patent [19]

Malachowski

[11] 4,356,667

[45] Nov. 2, 1982

[54] TILT LATCH FOR SLIDABLE WINDOW SASH

[75] Inventor: Frank Malachowski, Columbia Station, Ohio

[73] Assignee: Alcan Aluminum Corporation, Cleveland, Ohio

[21] Appl. No.: 179,008

[22] Filed: Aug. 18, 1980

[51] Int. Cl.[3] ..... E05D 13/00

[52] U.S. Cl. ..... 49/454; 49/161

[58] Field of Search ..... 49/161, 168, 181, 183, 49/184, 185, 186, 188, 189, 194, 453, 454, 449; 24/248 R, 255 SL

[56] References Cited

U.S. PATENT DOCUMENTS

| | | | |
|---|---|---|---|
| 2,017,652 | 10/1935 | Carl | 49/186 |
| 2,204,909 | 6/1940 | Pascuzzi et al. | 49/186 |
| 2,217,543 | 10/1940 | Gaines et al. | 49/186 X |
| 3,676,956 | 7/1972 | Taylor et al. | 49/181 X |
| 3,713,622 | 1/1973 | Dinger | 24/255 SL X |
| 4,038,726 | 8/1977 | Takabayashi | 24/248 R X |

FOREIGN PATENT DOCUMENTS

| | | | |
|---|---|---|---|
| 28851 | 8/1964 | German Democratic Rep. | 24/255 SL |

*Primary Examiner*—Philip C. Kannan

*Attorney, Agent, or Firm*—Cooper, Dunham, Clark, Griffin & Moran

[57] ABSTRACT

A tilt latch for a sliding window sash comprising a unitary molded plastic article including a base portion mountable on the top of a window sash, a body portion having a projecting nose for insertion in a channel of a window frame, and a narrow thin portion hingedly connecting the body to the base for enabling movement of the body between a closed position overlying the base and an open position. Two such latches are respectively mounted on opposite sides of a window sash; when the latch bodies are in the closed position, their noses are respectively received in vertical channels of the window frame for retaining the sash in the frame, while movement of the latch bodies to open position permits the sash to be tilted out of the frame. Each latch is provided with a manually releasable lock, such as a pin projecting from the base and received with interference fit in an opening of the body, for retaining the body in the closed position.

13 Claims, 10 Drawing Figures

Fig. 1.
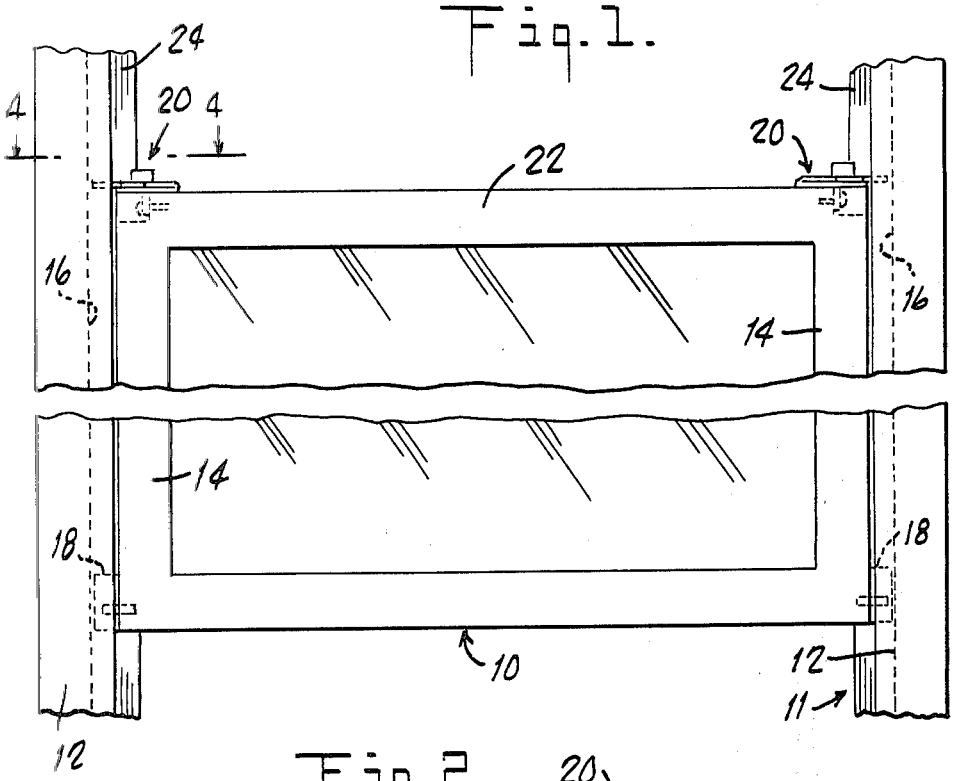
Fig. 2.
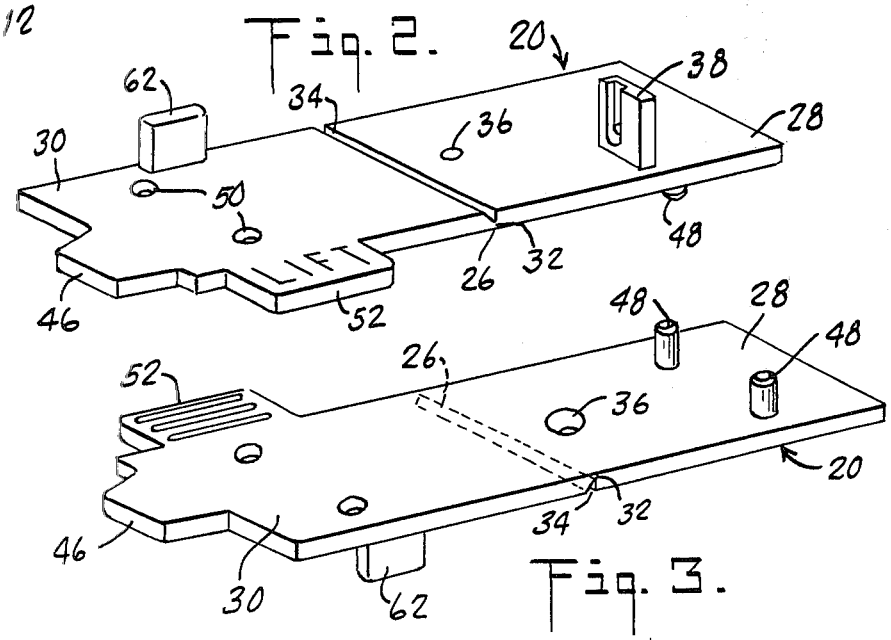
Fig. 3.

Fig. 4.
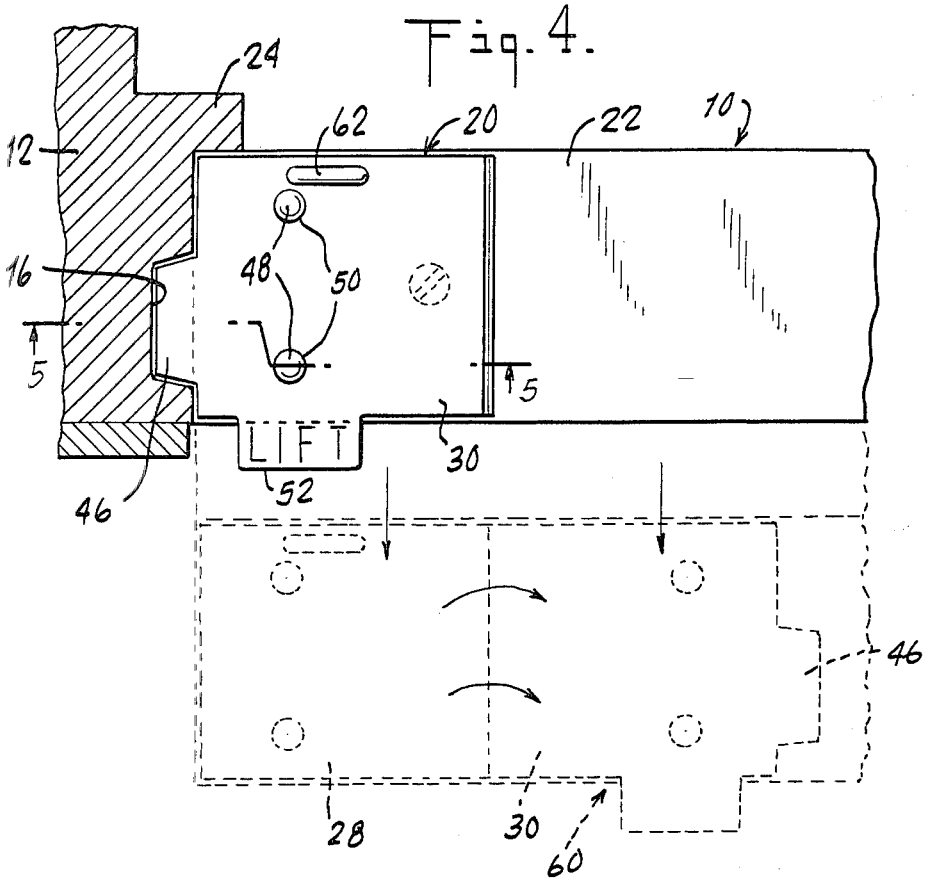
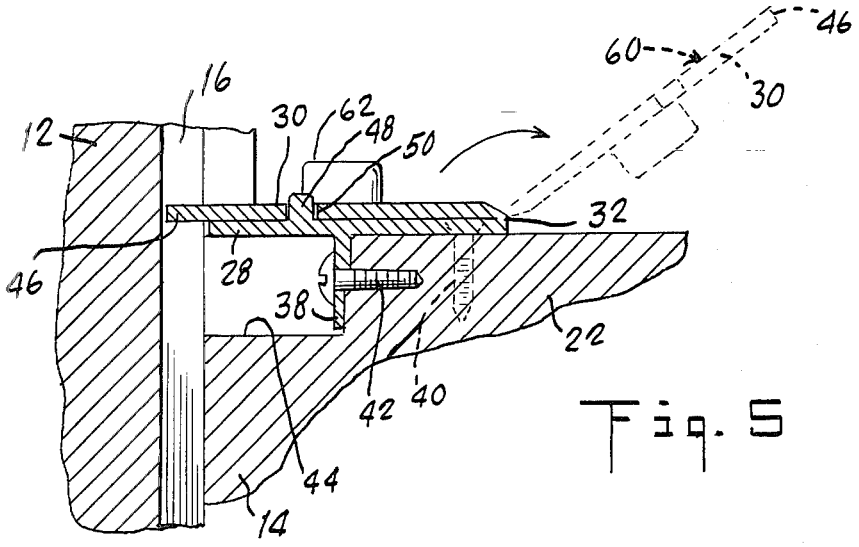
Fig. 5

Fig. 6.
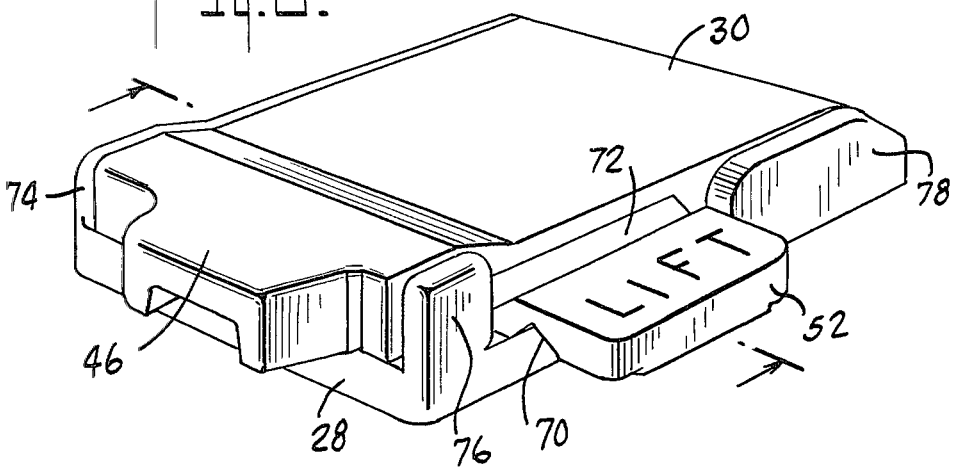
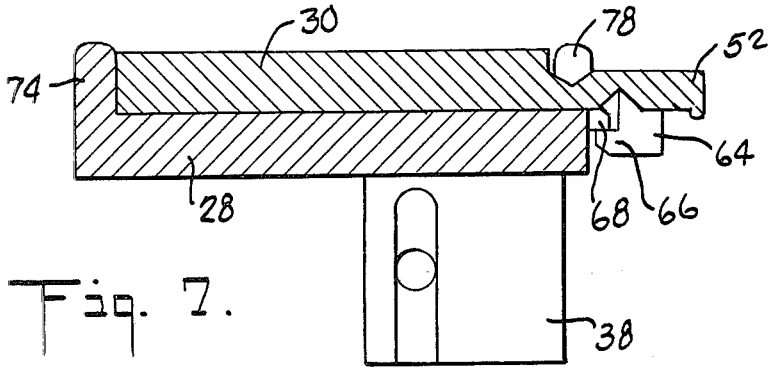
Fig. 7.
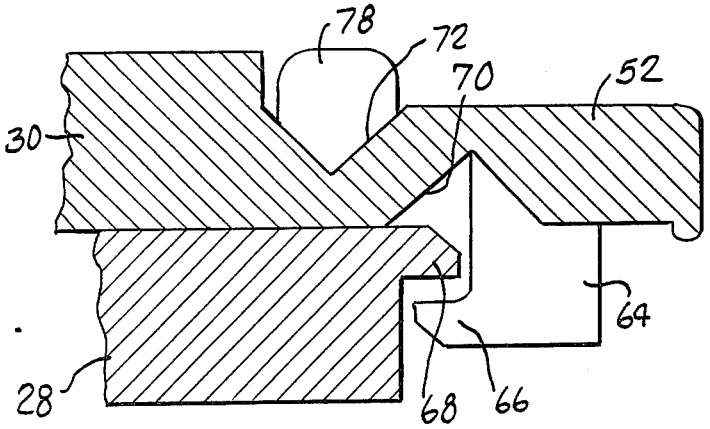
Fig. 8.

Fig. 9.
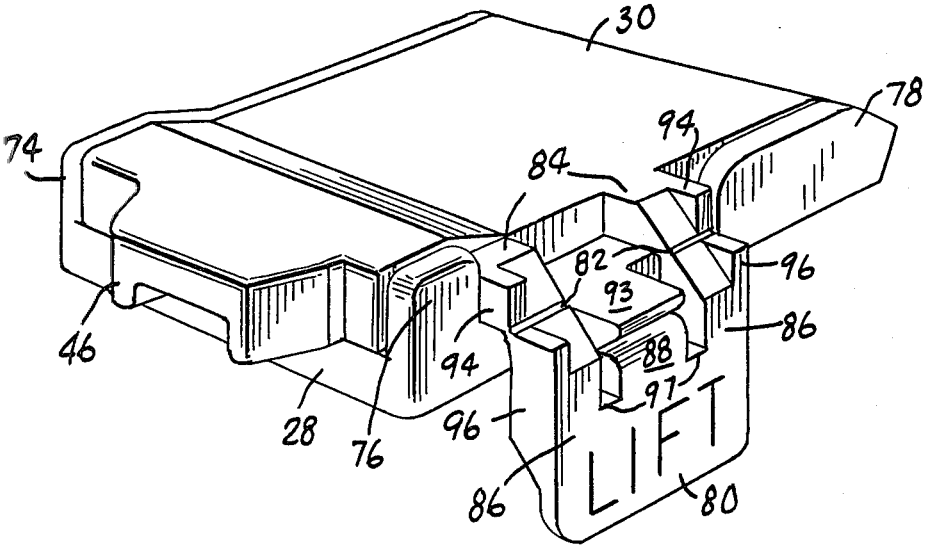
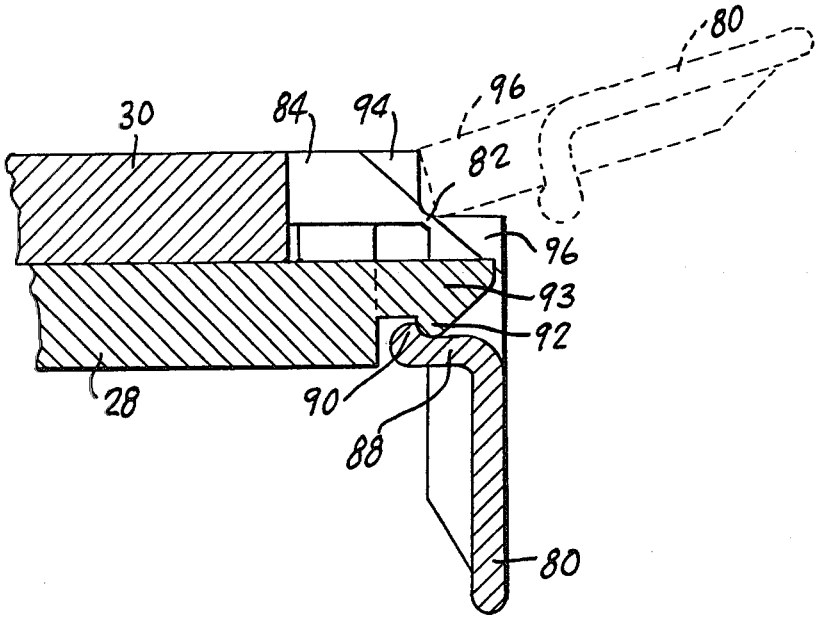
Fig. 10.

TILT LATCH FOR SLIDABLE WINDOW SASH

DESCRIPTION

Background of the Invention

This invention relates to window assemblies having sliding sashes, and more particularly to a new and improved form of tilt latch for releasably retaining a sliding window sash in a window frame.

Windows having sashes that slide vertically in fixed frames are sometimes arranged to enable the sash to tilt out of the frame when desired, as for cleaning, maintenance, or other purposes. To this end, the sash is provided with a pair of latches, mounted at the top of the sash respectively adjacent the sides thereof, and desired to ride in vertical grooves or channels formed in the two sides of the frame so as to retain the sash in its path of sliding movement in the frame, the latches being manually disengageable from the frame channels to release the sash for tilting out of the frame.

Latches having the above-described function (commonly termed tilt latches) are conventionally constructed in two or more parts, e.g. of molded plastic, and operate by slide action. Thus, a typical conventional tilt latch includes a latch slide bolt biased by a coil spring into an extended position in which it is inserted in a window frame channel but manually movable against the force of the biasing spring to a position in which the slide bolt is clear of the channel. As will be appreciated, operation of latches of this type is somewhat inconvenient in that the latches on both sides of a window sash must be manipulated simultaneously to free the sash from the frame for tilting. Moreover, the multipart construction of each latch can lead to problems in installation including loss of or damage to parts of the latch assembly.

SUMMARY OF THE INVENTION

The present invention concerns the provision of a tilt latch for releasably retaining a vertically slidable window sash in a window frame having two facing vertical channels extending along the sides of the sash for respectively receiving a pair of the latches carried on the sash, the sash being tiltable out of the frame upon withdrawal of the latches from the channel. Additionally, the invention contemplates the provision of a window assembly including such latches.

The tilt latch of the invention broadly comprises a base mountable on the top of a window sash adjacent a side thereof; a body having a free end including a nose insertable in a window frame channel; and a hinge interconnecting the base and body for enabling angular movement of the body between a closed position in which the body fully overlies the base with the nose disposed to be received in a window frame channel, and an open position in which the nose is clear of the channel. Further in accordance with the invention, the latch includes manually releasable means for retaining the body in the closed position. Manual force is exerted on the releasable means, to enable movement of the body from the closed to the open position, through a manually engageable projection extending laterally from the body. A stop projection, extending upwardly from the body, can also be provided for engaging the top of a window frame when the latch is mounted on a sash, to limit upward travel of the sash in the frame.

As a further and particularly important feature of the invention, the entire latch structure, including the base, body and hinge, are constituted as a unitary structure, thereby to facilitate installation of the latches. With particular advantage, the latch of the invention is provided as a unitary, integral, molded plastic article, the base and body being flat rigid portions of the article and the hinge being a narrow portion of the article intermediate the base and body and having a greatly reduced thickness as compared to the thickness of the base and body. It will be understood that the term "plastic" as used herein refers to moldable organic polymeric materials, e.g. synthetic resins such as linear polypropylene.

The latch of the invention affords desirable operating simplicity, as compared to the spring-biased latches heretofore known, in that, to achieve release of a sash from a frame, it is not necessary to manipulate both of the latches of the sash simultaneously; rather first one latch and then the other may be moved to open position by manually pivoting the bodies of the two latches to open position. In addition, the novel structural features of the latch permit the latch to be designed with a lower profile than is attainable in conventional latches, as is often desired for aesthetic reasons. Also, the one-piece latch has an enhanced useful lifetime without failure, again as compared to the multipart latches heretofore known.

Further features and advantages of the invention will be apparent from the detailed description hereinbelow set forth, together with the accompanying drawings.

BRIEF DESCRIPTION OF THE DRAWINGS

FIG. 1 is a schematic front elevation fragmentary view of a window assembly including two latches embodying the present invention in a particular form.

FIG. 2 is an enlarged perspective view, from one side, of a latch as shown in FIG. 1, with the latch illustrated in fully open position.

FIG. 3 is perspective view of the latch of FIG. 2, again in fully open position, but inverted to show the other side of the latch.

FIG. 4 is an enlarged view taken along the line 4—4 of FIG. 1.

FIG. 5 is a sectional view taken along the line 5—5 of FIG. 4.

FIG. 6 is an enlarged perspective view of another latch embodying this invention.

FIG. 7 is a sectional view taken along the line 7—7 of FIG. 6.

FIG. 8 is a further enlarged fragmentary sectional view, taken from the same vantage point as FIG. 7, illustrating the means for retaining the body of the latch in FIGS. 6 and 7 in the closed position.

FIG. 9 is an enlarged perspective view of a third latch embodying this invention.

FIG. 10 is a further enlarged fragmentary sectional view illustrating the means for retaining the body of the latch in FIG. 9 in the closed position.

DETAILED DESCRIPTION

Referring to the drawings, FIGS. 1, 4 and 5 illustrate schematically a window frame assembly including a generally conventional rectangular glazed window sash 10 mounted for vertical sliding movement in a window frame 11 which is in turn fixedly secured in a building wall (not shown). The opposite vertical sides 12 of the window frame (other portions of the frame being omitted from the drawing for simplicity of illustration) respectively engage in the opposite sides 14 of the sash, and are respectively formed with channels 16 extending vertically (in the direction of sash movement) over at least substantially the fully height of the frame. The two channels 16 are disposed to face each other across the space defined between the frame sides 12.

Specifically, the sash is retained in the frame by means of guides 18 mounted on the opposite sides of the sash adjacent the bottom thereof so as to project into the two frame channels 16, and by a pair of latches 20 respectively mounted on the top 22 of the sash adjacent the opposite sides of the sash and having portions likewise projecting into the frame channels 16. The sash is further prevented from outward movement relative to the frame by portions 24 of the frame sides overlying the side edges of the sash on the outer side of the window assembly. The sash is so dimensioned, however, what when the latches 20 are withdrawn from the frame channels 16, the sash can pivot or tilt inwardly relative to the frame about a horizontal axis coincident with the guides 18, e.g. for cleaning or other maintenance.

Apart from the form and structure of the latches 20, which will be described in detail below, the illustrated window assembly is intended to exemplify a generally conventional type of window having a vertically slidable sash so arranged as to be releasable and tiltable inwardly from the frame. It will be understood that the showing and the foregoing description of this window assembly are set forth merely to provide one specific example of an environment of use for the tilt latch of the present invention, and that the latch of the invention may be incorporated in other and different types of tiltable sliding sash window assemblies.

The latch 20 of the invention illustrated in FIGS. 1–5 is a unitary, integral molded article of a plastic such as linear polypropylene. As best seen in FIGS. 2 and 3, in as-mounted, fully open state (prior to installation), this article is of generally flat elongated rectangular configuration and is divided along a median line 26 into a rigid, flat rectangular base portion 28 and a rigid, flat rectangular body portion 30. The junction between portions 28 and 30, at the median line 26, is a narrow portion 32 of greatly reduced thickness compared to the thickness of portions 28 and 30; this portion 32 serves as a hinge permitting the body portion 30 to be folded over the base portion 28 until the body portion reaches the closed position shown in solid lines in FIGS. 4 and 5. In the closed position, the body portion fully overlies the base portion, i.e. the facing major surfaces of the base and body portions are then parallel to each other and in virtually continuous contact with each other over the full extent of the base portion.

To enable the desired angular movement of the body portion relative to the base portion about the hinge, and particularly to enable the body portion to reach the just-described fully closed position, the localized reduction of thickness at median line 26 providing the hinge is constituted by a groove 34 formed on only one side of the latch. That is to say, considering the latch in the uninstalled, fully open position of FIGS. 2 and 3, the major surfaces of the base and body portions which will come into contact in the closed position at line 26 on the same side of the latch (viz. the side facing upwardly in FIG. 3), and the reduced thickness of the hinge is constituted by the V-shaped groove 34 formed only on the other side of the latch, i.e. on the side facing upwardly in FIG. 2.

It is found that in a unitary latch article molded of a plastic such as linear polypropylene, sufficient reduction in thickness at the median line 26 to provide the desired hinge action can be readily achieved without so weakening the latch along line 26 as to cause premature failure. By way of specific example of a hinge of fully satisfactory flexibility for easy operation and adequate durability for long useful life with many openings and closings, the thickness at hinge portion 32 may be 0.015 inch, with the groove 34 having a 0.030 inch radius of curvature at its vertex and an overall divergence of 60°.

The base portion 28 is arranged to be mounted on the sash 10. To this end, it is provided with suitable mounting holes and/or projections such as screwhole 36 and mounting projection 38 (which, as seen in FIG. 5, is oriented downwardly when the latch is mounted on the sash) for use in securing the base 28 to the sash by means of fasteners such as screws 40 and 42 (FIG. 5). The arrangement of the base 28 in this respect may be designed to accommodate the particular configuration of window sash on which the latch is to be mounted. For instance, the sash 10 illustrated in the drawings has a recessed portion 44 in each upper corner; the mounting projection 38 of the latch base is shaped and located to seat within this recess 44, and to be secured by screw 42 to the sash at the inner wall of the recess. As will be apparent from the drawings, when the latch is mounted as described on a sash and the body portion 30 is in the fully closed position of FIG. 5, the fastening screw or screws holding the base portion 28 to the sash are fully concealed.

The free end of the body portion 30 (i.e. the end remote from the hinge) is shaped to constitute a nose 46 which is received within the channel 16 of a side 12 of the frame 11 and which conforms closely in configuration and dimensions to the cross-sectional shape of that channel. As further illustrated in FIG. 5, when the body portion 30 of the latch is in the fully closed position, the nose 46 projects beyond the base portion 28 and beyond the adjacent side of the sash 10 on which the latch is mounted so as to be properly positioned for insertion in the channel 16, it being understood that the latch base is so located on the top of the sash that the latch base does not overhang the side of the sash, and the hinge of the latch is oriented away from the side of the sash.

For retaining the latch body portion 30 in the fully closed position relative to the base portion 28, manually releasable means comprising pins 48 projecting upwardly from the base and sockets or openings 50 formed in the body portion are provided. Alternatively, the pins may project from the body, with the sockets or openings formed in the base. Pins 48, in addition to retaining the body in the closed position until it is manually released, absorb lateral loads on the latch such as might be applied if someone attempted to open the window without first releasing the latch. By absorbing these lateral loads, the pins prevent shearing forces on the thinner hinge portion 32 of the latch.

The openings 50 in the body may be slightly offset with respect to the positions of the pins 48 such that when the body portion is in the fully closed position relative to the base portion, there is an interference fit between the pins 48 and the openings 50, securely retaining the body portion in the closed position. In some cases, it may be desirable to include slots across the ends of the pins to allow the sides of the pins to flex and ease entry of the pins into the openings.

A lateral tab 52 projecting from a side edge of the body portion of the latch can be engaged manually (by the finger or fingers of a user) to transmit upwardly directed manual force to the body portion for overcoming the interference fit of the pins 48 in the openings 50 and pivot the body portion from the closed position to the open position 60 shown in broken lines in FIG. 5.

FIGS. 6–8 illustrate another embodiment of this invention with an alternative means for releasably securing the body to the base in the closed position. As best seen in FIG. 8, a post 64 depends from the laterally extending lift tab 52. An offset lip 66 on the rear face of post 64 deflects over a projection 68 extending laterally from the base as the body moves to the closed position. The offset lip 66 and the projection 68 provide a positive lock that secures the folded body in the closed position until a lifting force is applied to the bottom side of the lift tab 52, flexing the tab and deflecting the offset lip 66 outwardly past the projection 68, which allows the body to be moved to the open position.

Both the offset lip 66 and the base projection 68 are provided with tapered surfaces or lead angles to help the offset lip deflect over the projection as the latch is being closed. In addition, one or more grooves 70, 72 may be provided in the lifting tab 52 to allow the tab to flex more easily.

In this embodiment, the folding body 30 of the latch is narrower than the base 28, and upwardly extending rails 74, 76, 78 are provided along the edges of the base. The rails and the base define a channel that supports the folding body 30 in the closed position. The rails 74, 76, 78, like the pins in the embodiment shown in FIGS. 1–5, absorb lateral forces on the folding body 30, thereby avoiding shearing forces on the hinge portion of the latch.

FIGS. 9 and 10 illustrate yet another means for releasably securing the folding body to the base. In this embodiment, a locking member 80 is attached, by a second reduced thickness hinge 82, to two arms 84 that extend laterally from the folding body 30. Hinge 82, which is generally similar to the hinge 32 discussed above that connects the folding body 30 to the base 28, allows the locking member to pivot or move angularly from a locked position, shown in solid lines in FIGS. 9 and 10, to an unlocked position, shown in broken lines in FIG. 10.

As may be seen in FIG. 9, the locking member has two arms 86 which are connected to the arms 84 extending from the body by the reduced thickness hinge 82. There is a recess between the two arms 86 on the locking member, and a formed locking leg 88 at the base of this recess. At is best seen in FIG. 10, locking leg 88 extends at substantially right angles to the main plane of the locking member 80, and has an offset lip 90 at its free end. In the closed position, this offset lip 90 engages a similar offset lip 92 that depends from a projecting member 93 extending laterally from the base 28 of the latch. Referring again to FIG. 9, slits or notches 97 are provided between the arms 86 of the locking member and the locking leg 88. This allows the leg to deflect, which lets the offset lip 90 move over the stationary offset lip 92 as the locking member is opened or closed. Stops or shoulders 94, 96 are provided on both the arms 84 that extend from the folding body and the arms 86 of the locking member. As may be seen from the broken line view in FIG. 10, these stops 94, 96 limit the pivotal movement of locking member 80 in the unlocked position. Thus, the locking member 80 also serves as a lifting tab, which allows the latch to be opened in one simple motion by exerting manual force on the bottom side of the locking member 80. Similarly, the latch can be closed in one simple motion by moving the folding body to the closed position and pressing on the locking member to move the offset lip 90 on the locking leg over the stationary offset lip 92 on the base.

The various manually releasable means discussed above are merely exemplary of means for retaining the body portion in the closed position; in a broad sense, any locking arrangement capable of being conveniently provided in a molded plastic article, and designed to retain the body portion in the closed position but to be releasable by manual force acting to move the body portion to the open position can be employed.

Referring again to FIGS. 2–5, a stop projection 62 may be formed on that surface of the body portion which faces upwardly in the closed position for the purpose of engaging the top of the window frame when the sash reaches the upper limit of its travel so as to prevent overtravel of the sash in an upward direction. Alternatively, all or part of the latch itself, such as the free end (i.e. the end remote from the hinge where nose 46 is located) of the latches shown in FIGS. 6 and 8, may be made somewhat thicker to function as a stop.

Conveniently, the various projections, pins, screw holes and openings, locking members and secondary hinge of the latches disclosed above may all be formed in the initial molding operation together with the base, body and main hinge portions of the latch, to constitute the latch as a fully integral one-piece molded plastic article. Suitable molding techniques for producing articles having the structures described above will be apparent to persons of ordinary skill in the art of plastic molding, and accordingly need not be described.

The operation of the latch of the invention, when installed on a window sash 10, may now be readily explained. Assuming that a pair of the latches are mounted on the sash as shown in FIG. 1 and that the latch bodies are in the closed position of FIGS. 4 and 5, the sash is free to slide vertically in the window frame 11 but is prevented from tilting out of the frame or otherwise becoming misaligned owing to the presence of the latch noses 46 as well as the guides 18 in the frame channels 16. If the latches are opened, a step performed by simply manually moving the body portion of each latch from the closed position to the open position 60 of FIG. 5, the upper portion of the sash is no longer retained in the window frame and the sash can tilt inwardly relative thereto. The two latches need not be opened simultaneously, but may conveniently be opened in sequence, i.e. one after the other.

It is to be understood that the invention is not limited to the features and embodiments hereinabove specifically set forth but may be carried out in other ways without departure from its spirit.

I claim:

1. A tilt latch for releasably retaining a vertically slidable window sash in a window frame having two facing vertical channels extending along the sides of the sash for respectively receiving a pair of the latches carried on the sash, the sash being tiltable out of the frame upon withdrawal of the latches from the channel, said tilt latch comprising:

(a) a base mountable on the top of a window sash adjacent a side thereof;

(b) a body having a free end including a nose insertable in a window frame channel;

(c) a hinge interconnecting the base and body for enabling angular movement of the body between a closed position in which the body overlies the base with the nose disposed to be received in a window frame channel, and an open position in which the nose is disposed to be clear of the channel; and (d) a projection, extending from said body, through which manual force can be exerted to move said body from said closed position to said open position, said projection being disposed to be manually engageable when said tilt latch base is mounted on the top of a window sash and said nose is received in an adjacent vertical channel of a window frame.

2. A latch as defined in claim 1, including manually releasable means for retaining the body in said closed position.

3. A latch as defined in claim 2, wherein said releasable means comprises a pin projecting upwardly from said base and a portion of said body defining an opening for receiving said pin with an interference fit.

4. A latch as defined in claim 2, wherein said releasable means comprises a projection extending from said base and a locking member connected to said body by a second hinge that enables angular movement of said locking member between an unlocked position and a locked position in which the locking member engages the projection.

5. A latch as defined in claim 4, including stops to limit the angular movement of said locking member in the unlocked position so that said locking member can be used to move said body from said closed position to said open position.

6. A latch as defined in claim 4, wherein said locking member, said body and said secondary hinge are portions of a unitary, integral molded plastic article.

7. A latch as defined in claim 2, wherein said manually engageable projection extends laterally from said body, and is a projection through which manual force can be exerted on said releasable means to enable movement of the body from the closed position to the open position.

8. A latch as defined in claim 2, further including a stop projection extending upwardly from said body for engaging the top of a window frame when the latch is mounted on a sash, to limit upward travel of the sash in the frame.

9. A latch as defined in claim 1 or claim 6, wherein said base, said body and said hinge are portions of a unitary, integral molded plastic article.

10. A latch as defined in claim 9, wherein said base and said body are flat rigid portions of said article, and wherein said hinge is a narrow portion of said article, intermediate said base and said body, having a greatly reduced thickness as compared to the thickness of the base and body.

11. A latch as defined in claim 10, wherein the article is made of linear polypropylene.

12. A window assembly comprising (a) a window sash having a top and two sides;

(b) a window frame for receiving said sash for sliding vertical movement, said frame having two facing vertical channels respectively extending along the sides of the sash; and (c) a pair of tilt latches respectively mounted on top of the sash adjacent the two sides thereof for engaging the channels of the frame to retain the sash in the frame, the latches being disengageable from the channels and the sash being tiltable out of the frame when the latches are thus disengaged;

wherein the improvement comprises:

(d) each of said latches comprising (i) a base mounted on the top of said sash adjacent one side thereof;

(ii) a body having a free end including a nose insertable in the window frame channel adjacent the last-mentioned side of said sash; and (iii) a hinge interconnecting the base and body for enabling angular movement of the body between a closed position in which the body overlies the base with the nose received in the last-mentioned frame channel, and an open position in which the nose is clear of the channel.

13. A window assembly as defined in claim 12, wherein each of said latches, including the base, the body, and the hinge thereof, is a unitary, integral molded plastic article.

* * * * *